United States Patent [19]

Maijala

[11] 4,089,127

[45] May 16, 1978

[54] SNOW REMOVAL APPARATUS

[76] Inventor: William R. Maijala, 4029 Xenia Ave., No., Minneapolis, Minn. 55422

[21] Appl. No.: 781,831

[22] Filed: Mar. 28, 1977

[51] Int. Cl.[2] ..... E01H 5/02

[52] U.S. Cl. ..... 37/53; 294/54; 15/236 R

[58] Field of Search ..... 37/50, 53; 294/54–57, 294/59; 15/236 R

[56] References Cited

U.S. PATENT DOCUMENTS

| | | | |
|---|---|---|---|
| 2,823,470 | 2/1958 | Page | 37/53 |
| 2,891,330 | 6/1959 | Murphy | 37/53 |
| 2,950,547 | 8/1960 | Murphy | 37/53 |
| 3,026,138 | 3/1962 | Benjamin et al. | 294/55 |
| 3,091,790 | 6/1963 | Schroeder | 37/53 X |
| 3,186,750 | 6/1965 | Nelson | 294/59 X |
| 3,371,694 | 3/1968 | Miller | 294/55 X |
| 3,483,643 | 12/1969 | Wenzel | 37/53 |
| 3,773,375 | 11/1973 | Wehls | 37/53 X |
| 3,998,486 | 12/1976 | Mittelstadt | 37/53 X |
| 4,024,654 | 5/1977 | Snyder | 37/53 |

FOREIGN PATENT DOCUMENTS

| | | | |
|---|---|---|---|
| 896,296 | 2/1945 | France | 294/55 |

*Primary Examiner*—E. H. Eickholt
*Attorney, Agent, or Firm*—Burd, Braddock & Bartz

[57] ABSTRACT

A hand operated apparatus used to remove snow from the roof of a structure, as a house. The apparatus has a U-shaped chute with open front and rear ends. Upwardly inclined lips located across the bottom of the front and rear of the chute prevent the chute from digging into the roof. An elongated flexible sheet attached to the rear of the chute carries snow from the chute to the edge of the roof. A cord secured to the flexible sheet is used to maintain the position of the flexible sheet on the roof. An elongated handle pivoted to a side of the chute is used to move the chute up and down the roof.

10 Claims, 4 Drawing Figures

SNOW REMOVAL APPARATUS

BACKBROUND OF INVENTION

Snow accummulation on roofs should be removed to reduce snow loads on the roofs, prevent ice build up and water damage due to ice dams on the roofs. Handle tools, as shovels, long handle hoes, and blades, have been used to remove snow from roofs. These hand tools have limited reach and are difficult to manipulate on snow covered roofs. The use of conventional shovels is not a recommended means for removing snow from roofs. Walking on snow covered roofs is damgerous and increases the loads on the roofs.

SUMMARY OF INVENTION

The invention is directed to a hand operated apparatus used to remove snow from the roof structure. The apparatus is an open ended U-shaped chute having a flat bottom wall and upright side walls. The side walls taper outwardly from the front to the rear of the chute. Transverse lips project upwardly from the front and rear edges of the bottom wall to minimize digging of the chute into the roof during removal of snow from the roof. An elongated flexible sheet member attached to the rear of the bottom wall and side walls functions as a slide for carrying snow from the chute to the edge of the roof. A cord secured to sheet member is used to position the sheet member on the roof. A long handle attached to one side wall is used by the operator to move the chute into the snow and position the chute on the roof.

An object of the invention is to provide an apparatus usable to dig up and remove snow from the roof of a structure. Another object of the invention is to provide a light weight, low cost, hand operated apparatus that can be operated from the ground to remove snow from the roof. A further object of the invention is to provide an apparatus useable to remove snow from the roof without digging into the roof surface. These and other objects and advantages of the snow removing apparatus of the invention are set forth in this disclosure.

IN THE DRAWINGS

DESCRIPTION OF PREFERRED EMBODIMENT

Figure 1:
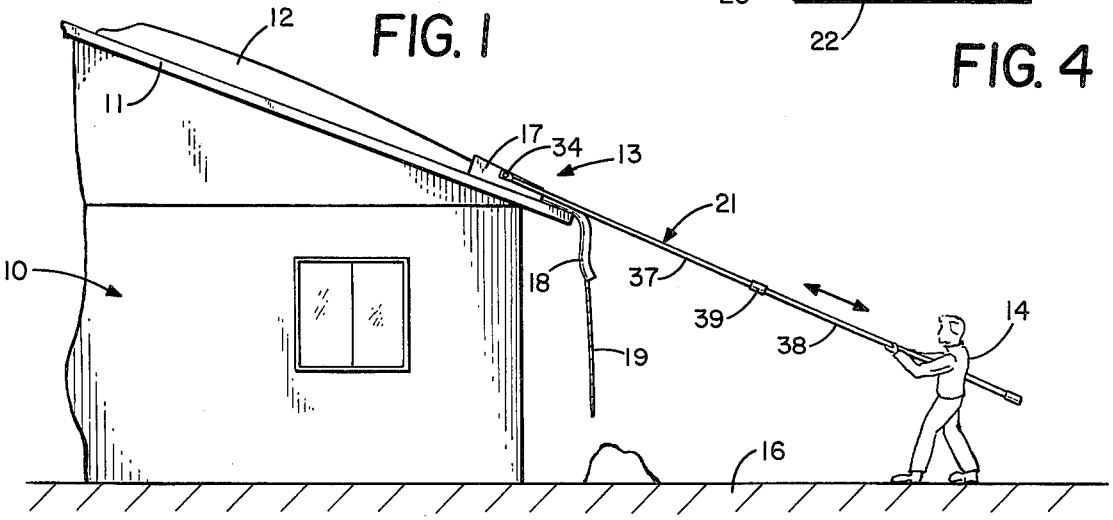
FIG. 1 is a side elevational view of the snow removing apparatus of the invention removing snow from the roof of a structure.

Referring to FIG. 1 there is shown a structure indicated generally at 10, as a house, garage, shed, or the like. Structure 10 has a pitched roof 11. An accumulation of snow 12 is located on roof 11. Snow 12 must be removed from the roof 11 to reduce the load on roof 11 and prevent ice dams which prevent the water from moving down the roof. Ice dams are usually formed along the lower edge of roof 11. Water trapped by these dams will run under the roof shingles into the structure. The apparatus indicated generally at 13 of the invention is operable to remove the snow 12 from roof 11. The apparatus 13 is a hand operated implement that is manipulated by a person 14 standing on the ground 16. Snow 12 is cut free from roof 11, scooped up, and guided over the edge of the roof so that it falls to ground 16.

Figure 4:
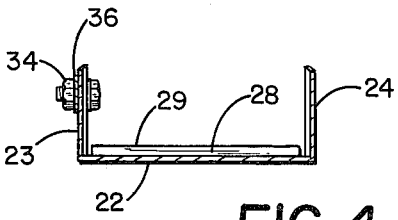
FIG. 4 is a sectional view taken along the line 4—4 of FIG. 2.
Figure 2:
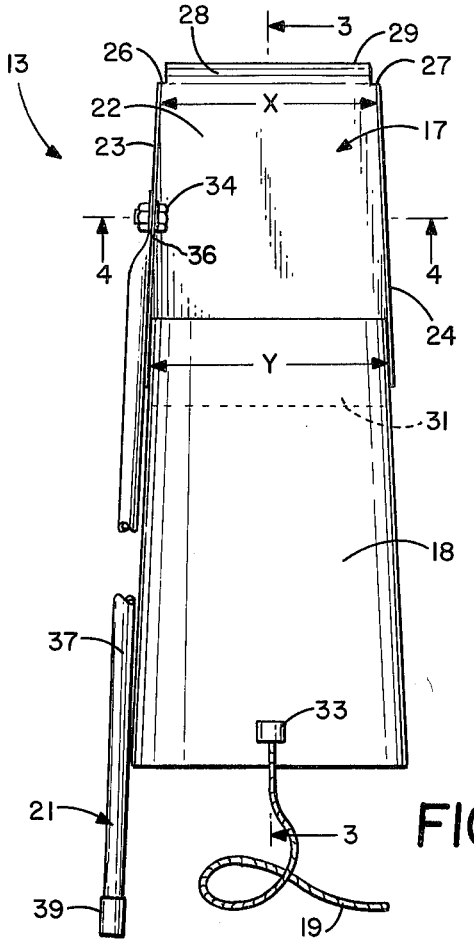
FIG. 2 is an enlarged top plan view of the snow removing apparatus of FIG. 1 with the handle foreshortened.
Figure 3:
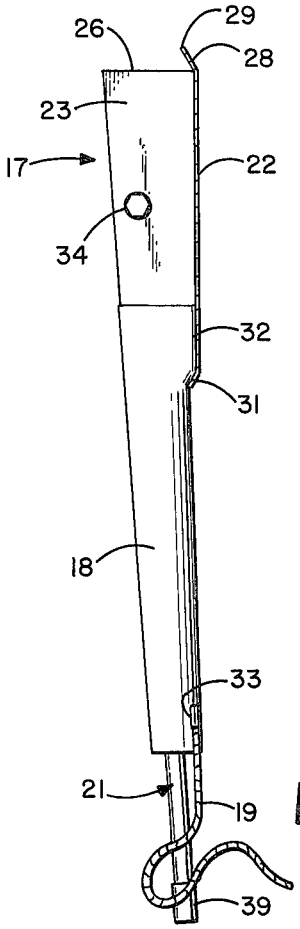
FIG. 3 is a sectional view taken along the line 3—3 of FIG. 2.

Referring to FIGS. 2, 3, and 4, apparatus 13 has a rigid U-shaped chute indicated generally at 17. An elongated flexible sheet member 18 is attached to the rear of chute 17. A cord chute 19 is attached to the exit end of sheet member 18. Sheet member 18 can be a flexible plastic material as polyvinyl chloride. Other types of plastics can be used for sheet member 18.

An elongated rigid tubular handle indicated generally at 21 is secured to one side of chute 17. Handle 21 is used by operator 14 to move chute 17 up the roof 11 to collect the snow 12.

Chute 17 has a flat rectangular bottom wall 22. Opposite edges of bottom wall 22 as integral with upright side walls 23 and 24. The front portions of side walls 23 and 24 are transversely spaced from each other by a distance X. The rear portions of side walls 23 and 24 are transversely spaced from each other by a distance Y. Distance Y is greater than distance X. The side walls 23 and 24 taper rearwardly whereby the chute passage becomes progressively larger from the front to the rear of the chute. Side wall 23 has an upright front edge 26. Side wall 24 has an upright front edge 27. Edges 26 and 27 are front cutting edges which dig into snow 12 as chute 17 is pushed up roof 11. A transverse lip of flange 28 is integral with the forward edge of bottom wall 22. Lip 28 extends along substantially the entire width of the bottom wall 22. As shown in FIG. 3, lip 28 projects forwardly and upwardly from the plane of bottom wall 22 and terminates in a transverse front edge 29. A transverse lip of flange 31 is integral with the rear edge of bottom wall 22. The upwardly directed extentions of lips 28 and 31 prevent the chute 17 from digging into roof 11 as it is moved up and down the roof. Chute 17 has a one piece sheet metal construction. Side walls 23 and 24 and lips 28 and 31 are cut to outline shape from flat sheet metal material and then bent to form the U-shaped chute. The sheet metal can be sheet aluminium, galvanized sheet metal, and the like.

The forward end of sheet member 18 overlaps a portion of the rear of chute 17. As shown in FIG. 3, an adhesive 32 bonds the sheet member 18 to the outside surfaces of side walls 23 and 24 and the top surface of the bottom wall 22. Other types of attaching means, as rivits, nuts and bolts, screws, tape and the like can be used to connect flexible sheet member 18 to the rear of chute 17. Sheet member 18 extends rearwardly over lip 31. Attaching means as an adhesive or tape 33 secures one end of cord 19 to the trailing or rear portion of sheet member 18.

The upper end of handle 21 is pivotally connected to midportion of side wall 23 with a nut and bolt assembly 34. Handle 21 can be attached to side wall 24. Handle 21 has a flat upper end 36 having a hole accommodating nut and bolt assembly 34. Handle 21 is a two part tubular structure having a first rigid tubular section 37 and a second rigid tubular section 38. A cylindrical connector 39 joins adjacent ends of the sections 37 and 38 thereby providing the handle with substantial length. This enables operator 14 to move and manipulate chute 17 on roof 11 while standing on the ground. Handle 21 can have additional tubular sections when it is necessary to remove snow from a two-story roof. Alternatively, handle 21 can be a single long tubular member.

In use, operator 14 couples tubular sections 37 and 38 together with connector 39 providing an elongated rigid handle 21. Chute 17 is positioned on the lower portion of roof 11 and moved up into the snow 12. Sheet member 18 is positioned rearwardly of chute 17 and aligned with the chute by the use of the cord 19. Operator 14 reciprocates chute 17 by moving handle 21 up and down to force the chute up into the snow 12. The front edges 26 and 27 and the transverse edge 29 dig and cut into the snow 12. A cut block of snow moves through the open front end of the chute into the chute passage. The forward end of chute has the small transverse dimension X. The snow is not compressed aganst the inside surfaces of upright walls 23 and 24 because the rear transverse dimension Y is longer than transverse dimension X. In other words, the rearward diverging taper of side walls 23 and 24 allows the snow to move through chute 17. The upward inclination of lips 28 and 31 prevents the transverse front edge from digging into the roof shingles or surface. The snow freely moves through the chute passage and out onto flexible sheet member 18. The sheet member 18 made of a plastic material has low friction characteristics whereby the snow freely and rapidly moves down the sheet member 18 and over the bottom edge of roof 11. The operator 14 moves the chute up abd down the roof 11 until the majority of the snow 12 has been collected and moved to the ground 16.

While there has been shown and described a preferred embodiment of this invention it is understood that changes in the size, materials, and structures can be made by those skilled in the art without departing from the invention. The invention is defined in the following claims:

The embodiments of the invention in which an exclusive property or privilege is claimed are defined as follows:

1. An apparatus for removing snow from the roof of a structure comprising: a generally U-shaped chute having a generally flat bottom wall, said bottom wall having opposite side edges, a transverse front wall edge and a transverse rear edge, upright side walls attached to the opposite side edges of the bottom wall providing a passage with open front and rear ends, and an upwardly directed transverse lip joined to the front edged, said lip extended forwardly from the front edge and at an upward edge angle relative tio the plane of the bottom wall, said lip having a transverse edge, an elongated flexible sheet member extended rearwardly from the rear edge of the bottom wall, meams attaching the sheet member to the bottom wall, an elongated handle used by an operator to move the chute, and means connecting the handle to the chute.

2. The apparatus of claim 1 including: a second transverse lip joined to the rear edge of the bottom wall of the cute, said second lip extended upwardly and rearwardly from said bottom wall.

3. The apparatus of claim 1 wherein: said upright side walls each have upwardly directed front edges, said lip located forwardly of a line extended between the front edges of the side walls.

4. The apparatus of claim 1 wherein: said upright side walls diverge in a rearwardly direction whereby the rear open end of the U-shaped chute is larger than the front open end of the chute.

5. The apparatus of claim 1 including: an elongated cord attached to the sheet member remote from the chute.

6. The apparatus of claim 1 wherein: the means connecting the handle to the chute is a connecting assembly having means allowing the handle to be angularly adjusted relative to the chute.

7. The apparatus of claim 1 wherein: the handle has a plurality of sections, and means for connecting said sections in end to end relationship to form said elongated handle.

8. The apparatus of claim 1 wherein: said handle has an end located adjacent one of the side walls, said means connecting the handle to the chute comprising means connecting the end to the one side wall.

9. The apparatus of claim 1 wherein: the side walls each have upwardly directed front edges, the lip has a length about equal to the transverse width of the chute, and is located forwardly of a line extended between the front edges of the side walls.

10. The apparatus of claim 9 wherein: said side walls diverge in a rearwardly direction whereby the rear open end of the chute is larger than the front end of the chute.

* * * * *

UNITED STATES PATENT AND TRADEMARK OFFICE

CERTIFICATE OF CORRECTION

PATENT NO. : 4,089,127

DATED : May 16, 1978

INVENTOR(S) : William R. Maijala

It is certified that error appears in the above-identified patent and that said Letters Patent are hereby corrected as shown below:

Column 1, line 14, "damgerous" should be --dangerous--.

Column 2, line 18, "as" should be --are--.

Column 2, line 46, "outside" should be --inside--.

Column 2, line 67, after "two-story", insert --or high--.

Column 3, line 13, "aganst" should be --against--.

Column 3, line 26, "abd" should be --and--.

Column 3, line 41, after "front", omit "wall".

Column 3, line 45, "edged" should be --edge--.

Column 4, line 2, after "upward", omit "edge";
same line, "tio" should be --to--.

Column 4, line 5, "meams" should be --means--.

UNITED STATES PATENT AND TRADEMARK OFFICE

CERTIFICATE OF CORRECTION

PATENT NO. : 4,089,127

DATED : May 16, 1978

INVENTOR(S) : William R. Maijala

It is certified that error appears in the above–identified patent and that said Letters Patent are hereby corrected as shown below:

Column 4, line 11, "cute" should be --chute--.

Column 4, line 43, after "front", insert --open--.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*